US009114404B2

(12) United States Patent
Alam

(10) Patent No.: US 9,114,404 B2
(45) Date of Patent: Aug. 25, 2015

(54) CARBON FIBER COMPOSITE DISCHARGE ELECTRODE

(75) Inventor: M. Khairul Alam, Athens, OH (US)

(73) Assignee: Ohio University, Athens, OH (US)

( * ) Notice: Subject to any disclaimer, the term of this patent is extended or adjusted under 35 U.S.C. 154(b) by 696 days.

(21) Appl. No.: 13/382,952

(22) PCT Filed: Jul. 8, 2010

(86) PCT No.: PCT/US2010/041352

§ 371 (c)(1),
(2), (4) Date: Jan. 9, 2012

(87) PCT Pub. No.: WO2011/005947

PCT Pub. Date: Jan. 13, 2011

(65) Prior Publication Data

US 2012/0227588 A1 Sep. 13, 2012

Related U.S. Application Data

(60) Provisional application No. 61/224,121, filed on Jul. 9, 2009.

(51) Int. Cl.
*B03C 3/41* (2006.01)
*B03C 3/60* (2006.01)

(52) U.S. Cl.
CPC ... *B03C 3/41* (2013.01); *B03C 3/60* (2013.01); *B03C 2201/04* (2013.01); *B03C 2201/10* (2013.01)

(58) Field of Classification Search
CPC ..... B03C 3/40; B03C 3/41; B03C 3/45; B03C 3/60; B03C 2201/04; B03C 2201/10
See application file for complete search history.

(56) References Cited

U.S. PATENT DOCUMENTS

| | | | | | |
|---|---|---|---|---|---|
| 3,425,190 | A | | 2/1969 | Ragland | |
| 3,819,985 | A | * | 6/1974 | Dusevoir | 96/88 |
| 3,918,939 | A | * | 11/1975 | Hardt | 96/99 |
| 3,957,462 | A | * | 5/1976 | Schminke et al. | 96/97 |
| 4,077,785 | A | * | 3/1978 | Hartshorn | 96/99 |
| 4,152,183 | A | * | 5/1979 | Honacker et al. | 156/78 |

(Continued)

FOREIGN PATENT DOCUMENTS

| | | |
|---|---|---|
| CN | 101357351 | 2/2009 |
| DE | 2311468 | 9/1974 |

(Continued)

OTHER PUBLICATIONS

Van Norstrand's Scientific Encylopedia, date not known, publisher not known, ed. or vol. not known, pp. 937-938.*

*Primary Examiner* — Duane Smith
*Assistant Examiner* — Sonji Turner
(74) *Attorney, Agent, or Firm* — Jason H. Foster; Kremblas & Foster

(57) ABSTRACT

A discharge electrode using carbon fibers, nanofibers and/or nanotubes to generate the corona discharge. The invention contemplates carbon fiber electrodes with or without a polymer matrix to form a composite, and a supporting configuration in which the fibers are wrapped helically around a supporting rod that extends along the length of the electrode. Another supporting configuration includes the fibers stretched across the gas flow path. Yet another supporting configuration includes mounting the fibers along the length of the support rod substantially parallel to the rod.

3 Claims, 17 Drawing Sheets

(56) References Cited

U.S. PATENT DOCUMENTS

| | | | | |
|---|---|---|---|---|
| 4,614,678 | A * | 9/1986 | Ganga | 428/74 |
| 5,296,019 | A | 3/1994 | Oakley et al. | |
| 5,792,243 | A * | 8/1998 | Meffert et al. | 96/83 |
| 6,221,136 | B1 | 4/2001 | Liu et al. | |
| 7,282,253 | B2 | 10/2007 | Marini et al. | |
| 7,976,616 | B2 * | 7/2011 | Alam | 96/83 |
| 2005/0028676 | A1 | 2/2005 | Heckel et al. | |
| 2008/0190296 | A1 | 8/2008 | Alam | |
| 2008/0202331 | A1 * | 8/2008 | Abdelkrim et al. | 95/5 |
| 2011/0056376 | A1 * | 3/2011 | Pasic | 96/97 |
| 2011/0065835 | A1 * | 3/2011 | Hayata et al. | 523/218 |

FOREIGN PATENT DOCUMENTS

| | | | | |
|---|---|---|---|---|
| DE | 4326895 | C1 * | 8/1994 | |
| GB | 1458952 | | 12/1976 | |
| JP | 52119579 | | 10/1977 | |
| WO | WO 9504601 | A1 * | 2/1995 | B03C 3/41 |
| WO | 2009009787 | | 1/2009 | |
| WO | WO 2009009787 | A1 * | 1/2009 | B03C 3/41 |

* cited by examiner

CARBON FIBER COMPOSITE DISCHARGE ELECTRODE

CROSS-REFERENCES TO RELATED APPLICATIONS

This application is a submission to enter the national stage under 35 U.S.C. 371 for international application number PCT/US2010/41352 having an international filing date of Jul. 8, 2010, for which priority was based upon U.S. Provisional Patent Application No. 61/224,121 having a filing date of Jul. 9, 2009.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

Charging electrodes are critical components used in electrostatic precipitators (ESPs), which are devices used to collect particles from gas streams, such as the streams from electric power plants burning coal. Examples of such devices are shown in U.S. Pat. No. 6,231,643 to Pasic, et al., and United States Patent Application Publication No. US2008/0190296 published Aug. 14, 2008, both of which are incorporated herein by reference.

The most basic ESP contains a row of wires followed by a stack of spaced, planar metal plates. A high-voltage power supply transfers electrons from the plates to the wires, developing a negative charge of thousand of volts on the wires relative to the collection plates. In a typical ESP, the collection plates are grounded, but it is possible to reverse the polarity.

The gas flows through the spaces between the wires, and then passes through the rows of plates. The gases are ionized by the charging electrode, forming a corona. As particles are carried through the ionized gases, they become negatively charged. When the charged particles move past the grounded collection plates, the strong attraction causes the particles to be drawn toward the plates until there is impact. Once the particles contact the grounded plate, they give up electrons, and thus act as part of the collector. Automatic "rapping" systems and hopper evacuation devices remove the collected particulate matter while the ESPs are being used, thereby allowing ESPs to stay in operation for long periods of time.

The ESP has evolved as discharge electrodes have been developed, such as rigid discharge electrodes to which many sharpened spikes are attached, maximizing corona production. ESPs perform better if the corona is stronger and covers most of the flow area so particles cannot flow around the charging zones and escape being charged, which is called "sneakage".

Conventional discharge electrodes are supported on a metal structure, which typically includes a support rod. The rods are conductive in order to electrically connect each spike point with the power supply. Generally, it is considered necessary to have metal spikes that can withstand the electrical currents that often flow due to sparking over between the collection substrate and discharge electrode. The sharp spikes of the charging electrodes are also typically made of an expensive alloy (e.g., HASTELLOY brand alloy) to avoid or mitigate corrosion in the harsh environments in which such electrodes are used. The entire discharge electrode, including the rod, is commonly made of the alloy, causing the electrodes to be expensive and heavy, thereby requiring strong support structures.

Polymers are inexpensive, light and corrosion-resistant, but they do not conduct electricity, and they have poor tensile/flexural strength. Even conductive composites have much lower conductivity than metals. Therefore, the need exists for a discharge electrode that is lightweight and inexpensive, but still has a sufficient current flow and particle collection efficiency.

BRIEF SUMMARY OF THE INVENTION

The invention is a new design of charging electrodes using carbon fibers, nanofibers and nanotubes to generate the corona discharge. A goal of the technology is to produce low cost electrodes that are corrosion resistant. The invention includes carbon fiber electrodes, both with and without a polymer matrix to form a composite Composites are much lighter than metals—so the weight of the electrodes is also reduced. Composites have high strength and can be used to fabricate electrodes of high durability and long operating life.

The technology has strong potential applications in the pollution control from boiler exhausts, ESPs (specially wet ESPs) and air-purifiers. Composite materials are becoming increasingly popular among various manufacturing processes that use electrodes. ESPs are widely used to remove particulate matter from the stacks of coal-fired power plants. The technology could help provide cost savings due to high strength and corrosion-resistant properties of the electrodes.

The invention has several advantages over other commercially available charging electrodes, including improvement in the charging characteristics of the electrode; lower cost of the electrodes due to use of inexpensive, lighter materials and simpler design; lower cost of overall equipment as the cost of any supporting structure is eliminated or reduced. Furthermore, variation in the composition and physical configuration of the electrodes is feasible depending on the requirements and conditions of their operation, and collection efficiency is improved due to improvement in the airflow pattern. Corrosion resistance is enhanced in environments that would adversely affect metallic electrodes.

Electrodes of different designs have been fabricated according to the invention and tested under a set of varying conditions to determine their performance. Tests were performed to determine the voltage-current (V-I) characteristics and the collection efficiency of the electrodes. It was observed that electrodes using carbon fibers as sources of corona discharge had improved corona current at varying voltage levels as compared to expensive stainless steel electrodes.

As shown in FIG. 21, a discharge electrode for use in an electrostatic precipitator having a power supply connected to at least one collection electrode and a flow of gas across the discharge electrode and the collection electrode, the discharge electrode comprising at least one carbon fiber electrically connected to the power supply and exposed to the flow of gas. High voltage is applied by the power supply between the discharge electrode and the vertical membrane collection electrode with the discharge electrode preferably having a negative polarity and the membrane collection electrode being grounded.

Figure 1:
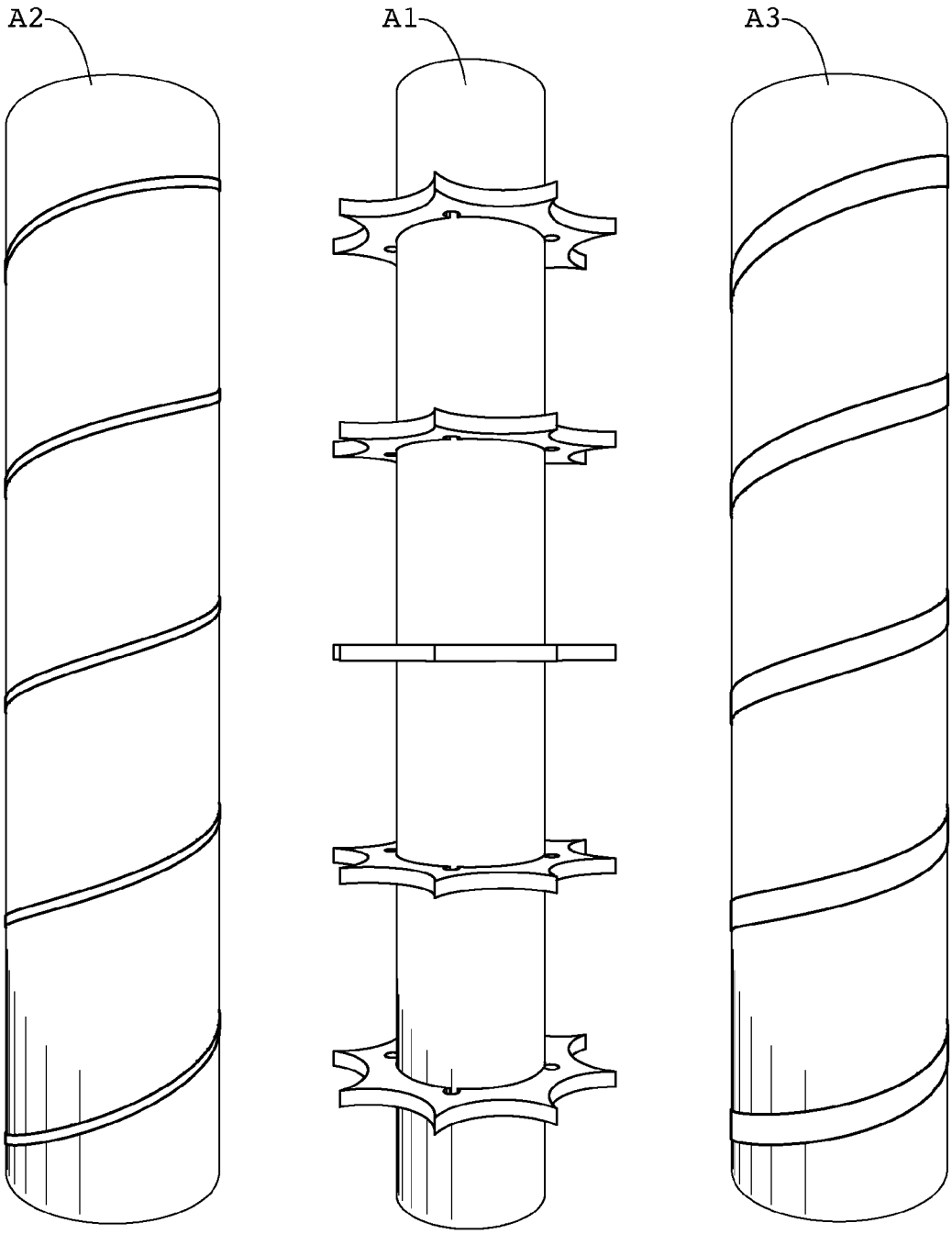
FIG. 1 is a side view illustrating the three electrodes used in test A. The electrode on the left is a carbon roving wrapped on a polymer support rod (A2), the "ninja star electrode" (A1) is in the middle, and the electrode (A3) on the right has a composite tape with carbon roving and carbon nanofiber (CNF) in a polymer matrix.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

U.S. Provisional Application No. 61/224,121 filed Jul. 9, 2009 is incorporated in this application by reference.

The invention is directed to discharge electrodes made of a combination of one or more of the following components: electrically non-conductive fibers and conductive, non-metallic fibers such as carbon fibers, carbon nanofibers and polymer. Carbon fibers and/or carbon nanofibers (CNFs) are common components in all the electrodes contemplated.

The fiber and/or composite electrodes can be supported by a support rod, such as by wrapping the conductive filaments around or along the rod, or the fibers can be wound around two substantially parallel, spaced support rods that apply tension to the filaments. In the latter case, the conducting filaments are wound around both supports, producing an array of filaments extending between the rods. In a preferred embodiment, the span extends across a path through which gases flow. In some cases in which nanofibers are in a composite, the ends thereof serve as points to support a corona.

Examples of electrodes made according to the invention are shown in FIG. 1. A bare carbon fiber roving electrode (A2) is shown wrapped helically around the outside of a cylindrical polyvinyl chloride (PVC) pipe. The carbon fiber roving is a grouping of substantially parallel fibers that are clustered together but not adhesively attached to one another. The fibers have diameters in the range of a few microns, but this can vary by orders of magnitude greater or lesser. The roving is adhered or mechanically mounted at the ends to the pipe to prevent movement, and can be attached along the length thereof by mechanical fasteners or adhesive patches. The pitch of the helical roving is two inches in order to be comparable to the ninja star electrode (A1) shown in FIG. 1 and discussed below.

It is contemplated that any grouping of conductive, non-metallic fibers can be used as an electrode material, and carbon is considered the most viable material. The conductive fibers can be combined with non-conducting fibers, such as glass fibers, in order to obtain some structural or cost-saving advantage. For example, carbon nano-fibers can be combined with glass fibers in a composite through which thermoplastic resin is infiltrated and then cured.

The carbon can be in the form of a roving or tow of fibers, as described above, but also can be in the form of a yarn, such as a string of very short fibers (e.g., nanofibers) clustered together in the manner of a yarn to form an elongated product that is orders of magnitude longer than it is in diameter. Such strings or yarns can be composites, such as by infiltrating with a curable and/or melted thermoplastic polymer fluid. A polymer matrix has the added benefit of aiding in thermal dissipation from the fibers, thereby possibly preventing or mitigating oxidation (burning), but also possibly reducing slightly the effectiveness of the electrode. It is also contemplated to coat carbon fibers with metal, such as HASTELLOY brand alloy or any stainless steel that can withstand the environment. Additionally, any polymer that can also withstand the environment can be used to coat the fibers.

Another electrode example is made of a composite tape formed by pultruding a carbon roving through polypropylene (PP) to form the tape electrode (A3). The tape is flexible and in the form of a flat strip. The tape is wrapped helically around the support rod (PVC pipe) with a pitch of two inches and attached at opposite ends to the pipe. The tape can be attached to the pipe along the length.

Figure 4:
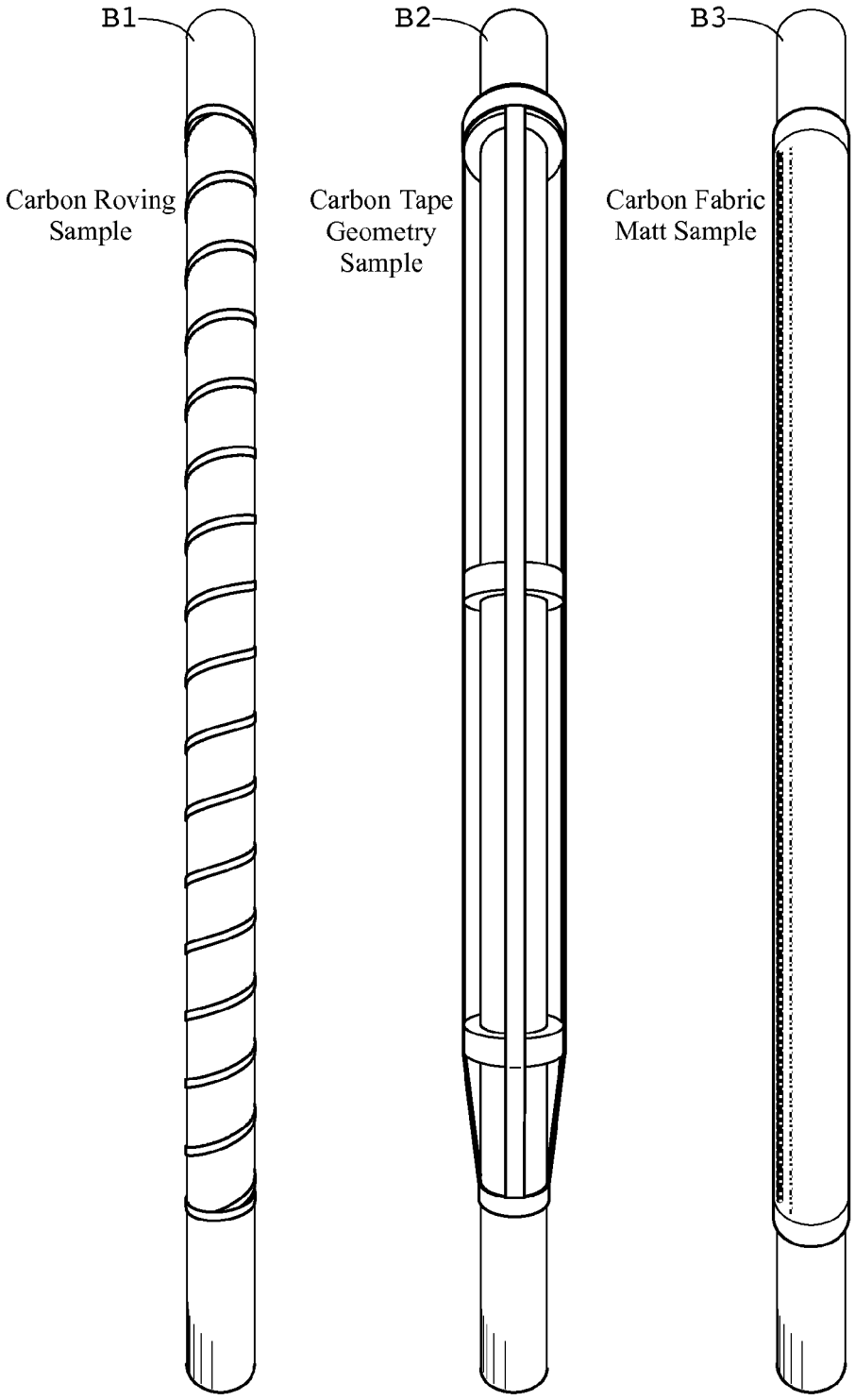
FIG. 4 is a view in perspective illustrating the electrodes tested in test B, which include a carbon roving wrapped around a support rod (B1), four composite tapes with glass fibers and CNF stretched along the support rod (B2); and a carbon nanofiber fabric wrapped around the rod (B3). These were compared with a ninja star electrode similar to the A1 electrode.

Other examples of electrodes are shown in FIG. 4, and the electrodes tested include a carbon roving wrapped helically around a support rod (B1). This is similar to the electrode A2 above. The electrode B2 is made of four composite tapes with glass fibers combined with carbon nano-fibers (CNF) stretched along a support rod made of a PVC pipe. The composite tapes are substantially parallel to the support rod during at least a portion of their extension along the support rod.

Another example in FIG. 4 of an electrode made according to the invention is the carbon nanofiber fabric (B3) wrapped around the PVC pipe. The carbon nanofiber fabric is made of nanofibers that are on the order of nanometers in diameter and a few microns in length formed into a fabric by infiltration with a polymer matrix material that is cured. The fabric is wrapped around the pipe and fixed to the pipe at the ends and along the seam formed by the overlapping edges. Tape is shown but other fasteners can be used.

Figure 7:
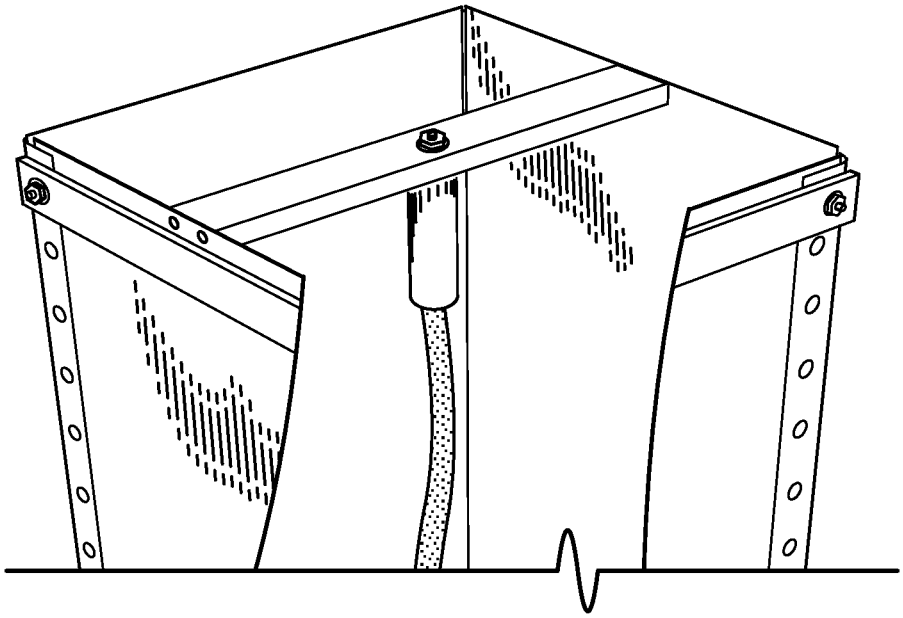
FIG. 7 is a view in perspective illustrating the single tape experiment apparatus without the use of a support rod.

The electrodes can be unsupported, such as by extending the tape or roving by itself across a gas flow path (i.e., without any rigidifying support), as shown in FIG. 7. In this example, a carbon fiber roving or tape is clamped at opposing ends, and then the ends are pulled in opposite directions to create tension in the roving or tape. The tension maintains the position of the electrode in the gas flow path, such as a chimney, flue or duct, in the presence of gas flowing rapidly across the electrode in a transverse direction. Cylinders that are contemplated to hold the roving or tape ends include substantially parallel, spaced cylinders around which the electrode material is wrapped and fixed, and at least one of the cylinders is then displaced in a direction opposite the other.

Figure 9:
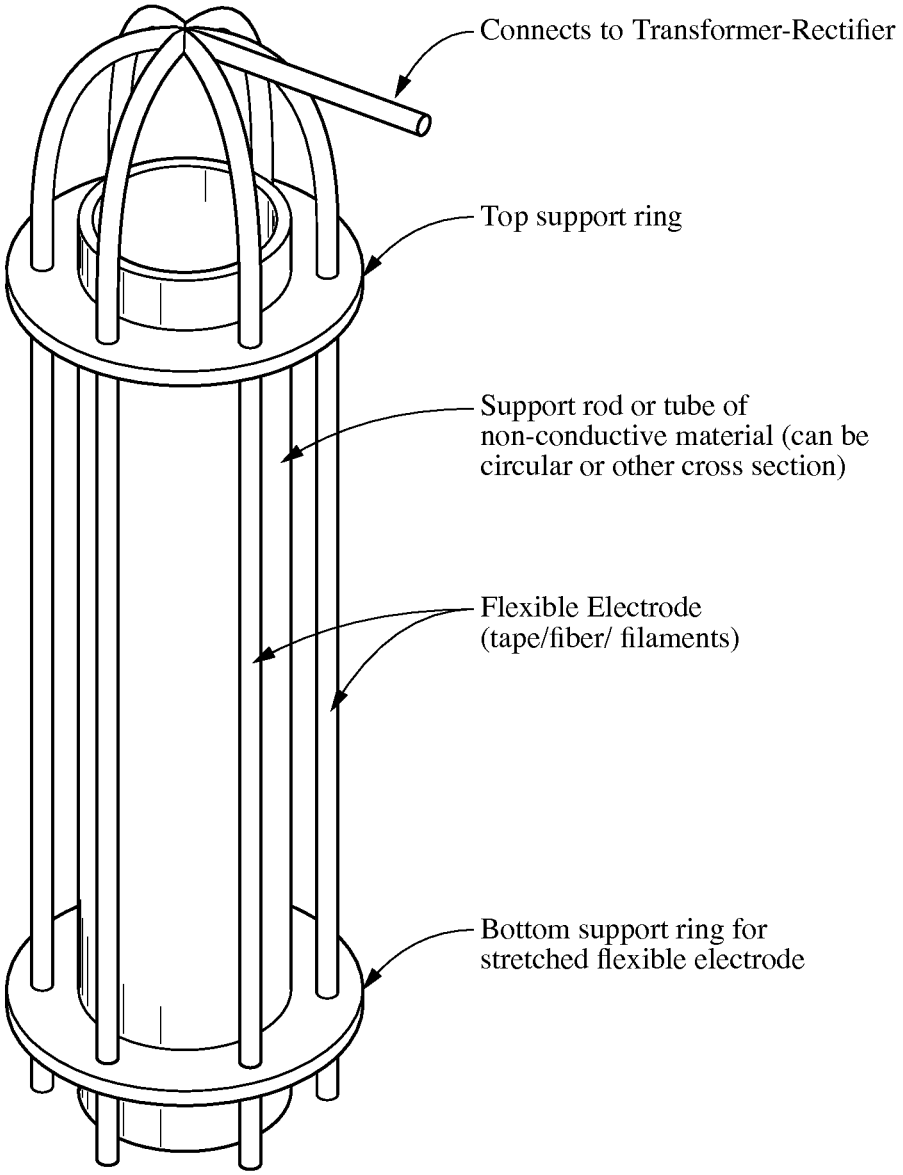
FIG. 9 is a schematic diagram illustrating one possible configuration of the discharge electrode system. The flexible electrode can be a composite tape or tows of fibers or filaments. The support rod can be non-conductive, such as a composite fiberglass tube.

The electrodes can also be supported along their length, such as by being helically wrapped around a preferably electrically non-conductive rod or pipe (see FIG. 1). In an alternative embodiment, the roving or tape can be aligned substantially parallel to the support pipe or rod, as shown in FIGS. 4 (see B2) and 9. In FIG. 9, the flexible electrodes are spaced radially from the exterior of the support rod, which increases gas flow across the surface of the electrodes. However, it is contemplated that the electrodes can be mounted substantially parallel to the support pipe and in contact therewith, as shown in FIG. 4 (see B3).

Figure 20:
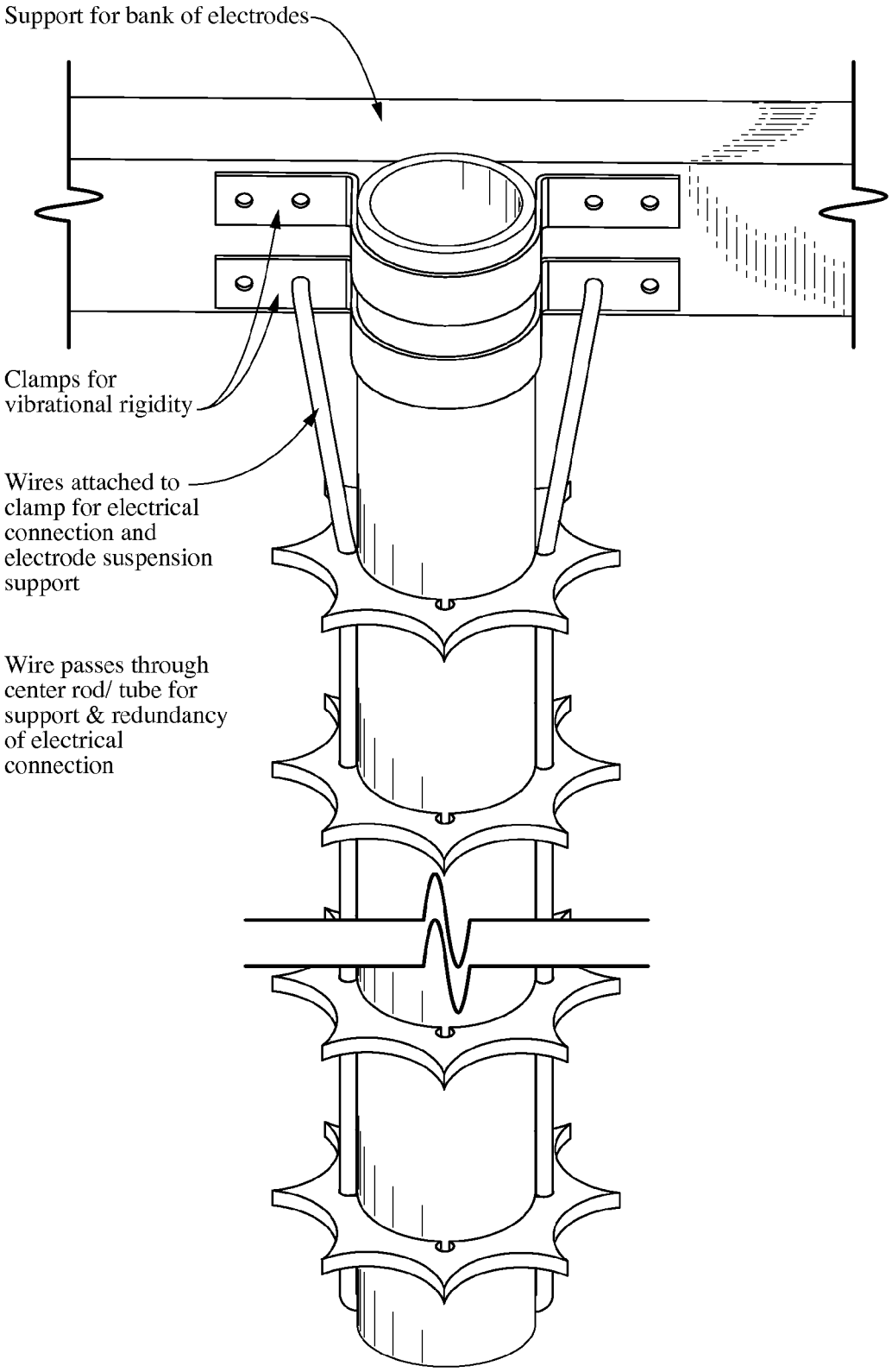
FIG. 20 is a view in perspective illustrating a contemplated support system for an electrode that incorporates the present invention, even though the electrode shown may not incorporate the present invention.
Figure 21:
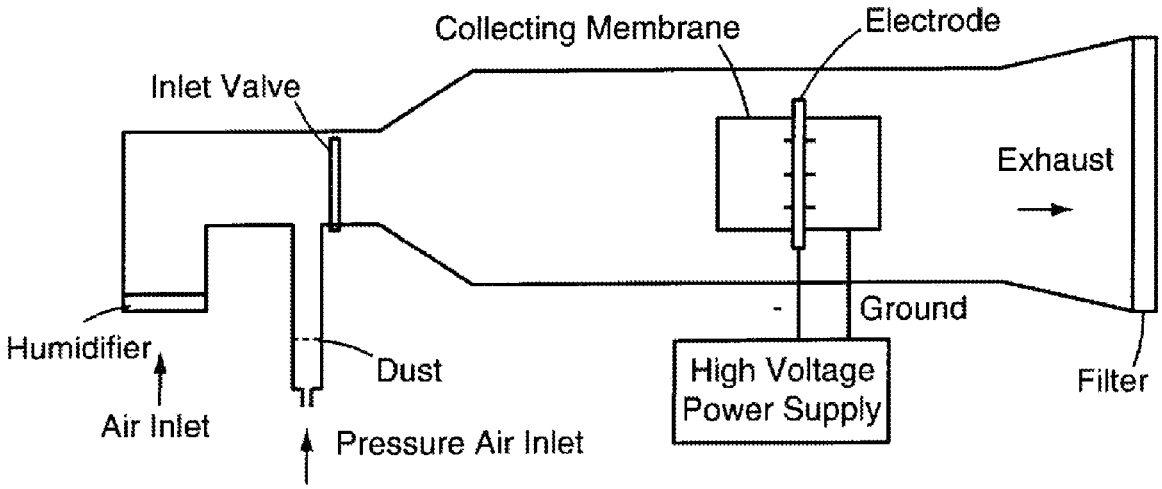
FIG. 21 is a side schematic view illustrating an experimental apparatus.

In yet another embodiment, an example of which is shown in FIG. 20, electrodes can be mounted at only one end to form a cantilever. Another example of this is not illustrated, but is configured as a round brush, having a configuration resembles a conventional bottle brush, in which fibers or composites extend radially outwardly from a rigid central supporting shaft. The central shaft is conductive and supports the ends of the electrodes. In an alternative, the radially-extending fibers are embedded in plastic, such as by the plastic flowing around the inner ends.

The test of the electrodes described herein consisted of the measurement of their corona current (I) discharge as a function of voltage V (the V-I curve). The following materials were tested as the source of the discharge current from the electrode: continuous (long) carbon fibers in the form of a roving; tape of carbon fibers in a polymer matrix; tape of carbon roving and carbon nanofibers in a polymer matrix; carbon nanofibers in the form of a fabric; tape of glass fiber with carbon nanofibers in a polymer matrix; and carbon fibers in the form of a brush. All of these were in the form of non-rigid materials and therefore they needed to be supported in the electrode form.

The above were tested successfully using a support structure. Tapes and bundles of fibers (such as carbon roving) can also be used without a support. Discharge electrodes can be made using bundles of fibers of small diameter (less than 250 microns) made from other electrically conductive, non-metallic materials. The present invention uses tows of fibers that are not infiltrated with a matrix material, such as a resin, as well as fibers that are infiltrated with a matrix material. Composites are preferred for structural integrity, and it is preferred that the conducting filaments have a small diameter (e.g., 5-7 microns).

The above-described electrodes were compared against a conventional metal electrode known as "ninja star electrode". The three sets of tests (referred to as tests A, B and C) on composite discharge electrodes are described below. Most of the configurations used a conductive composite tape made of fibers in a polymer matrix such as polypropylene (PP). In the first two sets of tests, the conductive component was supported by a "support rod" made of a non-conductive polymer pipe (as in the United States patent application Publication that has been incorporated above by reference).

The electrodes were tested in various lengths, with one set of results obtained with a 10 feet long discharge electrode. The testing chamber was a vertical, 16 feet long rectangular steel duct shown in FIG. 2. Several tests were conducted in a shorter chamber shown in FIG. 5 in which the test length of the electrode was approximately 21 to 24 inches.

Several electrodes were evaluated in the two chambers by comparing their results with a ninja star electrode. In all cases, the discharge electrodes were geometrically equivalent in their external diameter. The electrode performance is judged on the basis of the discharge current (I) as a function of the applied voltage (V). V-I curves were drawn with and without air flow. Dust was also injected into the airflow to simulate an electrostatic precipitator.

The following are the detailed results from three sets of experiments. The tests described below are representative of several tests conducted over an extended period.

Test Set A:

The purpose was to compare three electrodes. A ninja star electrode (A1) is used as the baseline for the tests. The ninja star electrode was made of stainless steel with ninja stars of 2 inch diameter welded to a steel support rod at 2 inch intervals. This design is based on a commercially produced electrode made by Southern Environmental, Inc. (Pensacola, Fla.). The first electrode that is in accordance with the invention is a bare carbon roving electrode (A2) wrapped helically around a PVC pipe. The pitch was set at 2 inches to be comparable to the ninja star electrode. The second electrode according to the invention is a tape of polypropylene (PP) pultruded with carbon roving electrode (A3) wrapped helically around a PVC pipe support rod with a pitch of 2 inches.

Figure 2:
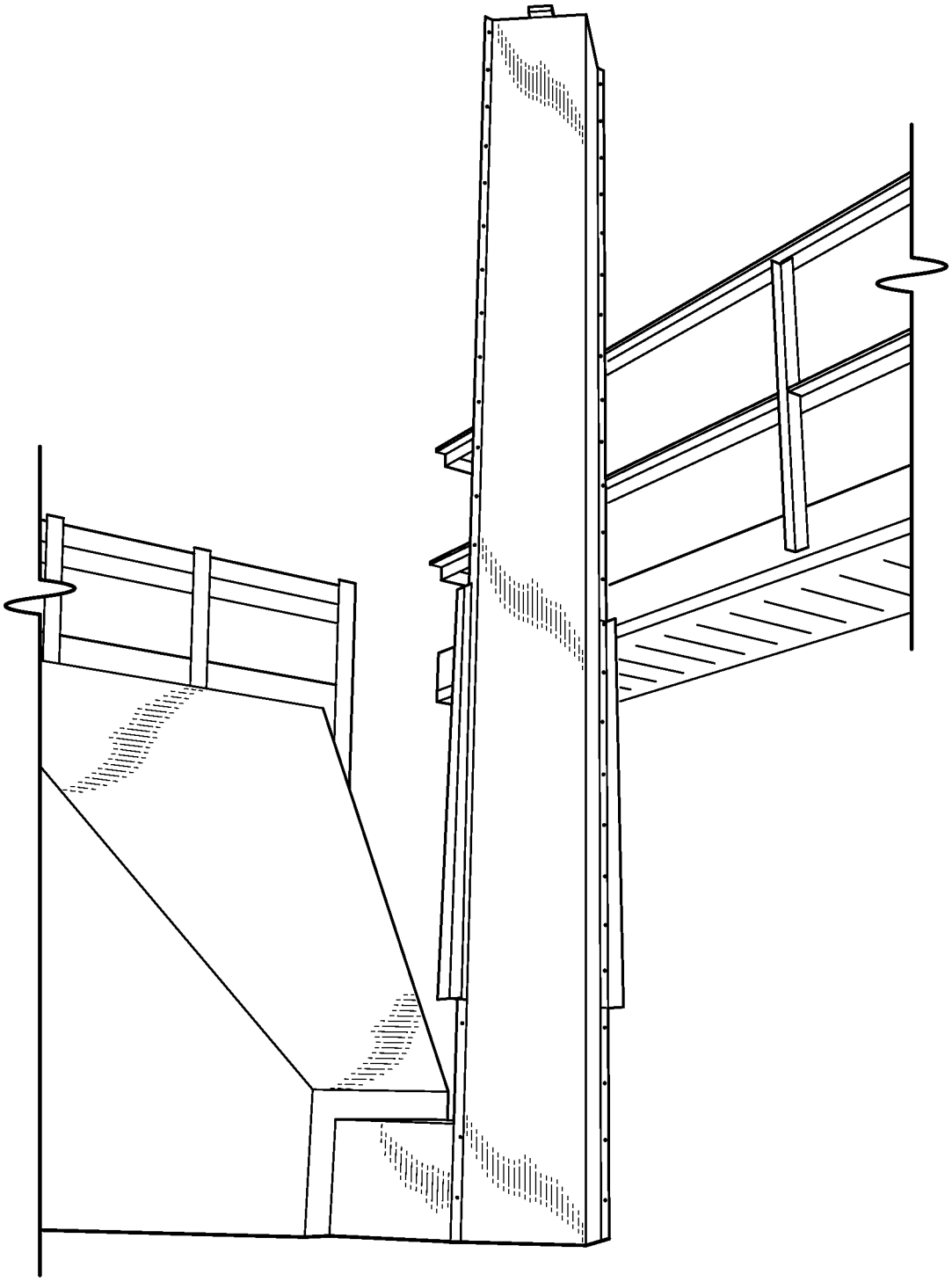
FIG. 2 is a side view illustrating the 16 feet tall chamber used for electrode testing in test A.
Figure 3:
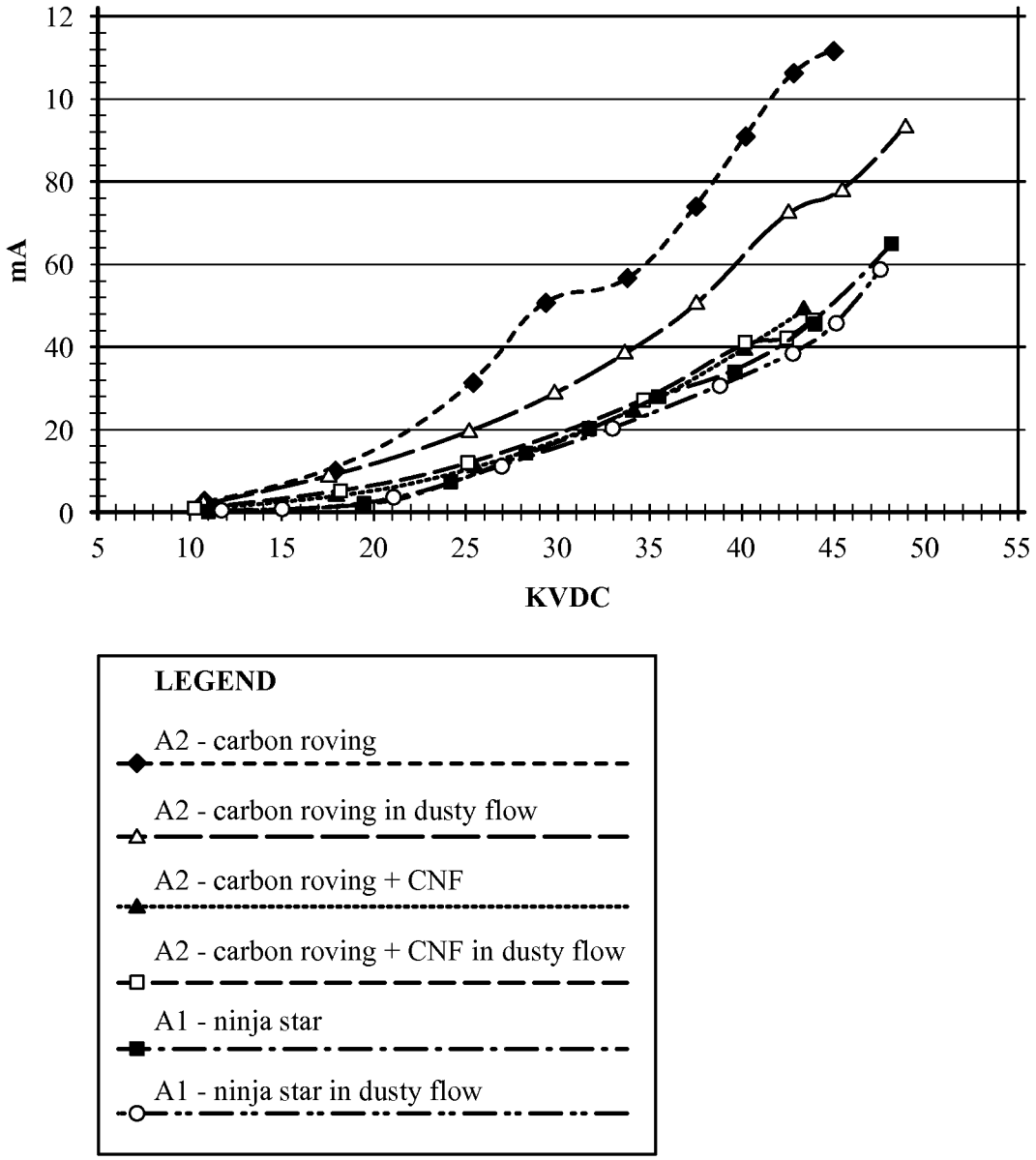
FIG. 3 is a table illustrating the results of V-I tests from test A with the three electrodes with and without dusty flow.

The three different electrodes used in test A are shown in FIG. 1. The testing chamber is shown in FIG. 2, which shows the 16 feet tall chamber used for electrode testing in test set A. The results for the three electrodes for test set A are shown in FIG. 3 in terms of current vs. voltage (V-I) characteristics. Each electrode was tested with and without airflow. The airflow was accompanied by dust injection. Higher currents indicate better electrode performance.

Conclusions that can be drawn from test set (A) are that the carbon roving electrode (A2) produces the best results. Even when the V-I performance degrades significantly with the flow of dust, it is still better than the other two electrodes. Additionally, the electrode (A3) of polypropylene and CNF pultruded tape with carbon roving performed slightly better than the baseline electrode (A1). This result has been consistent through several runs. The effect of a dusty flow is to reduce the discharge current, but the effect is much less significant with the ninja star electrode (A1) and composite tape electrode (A3).

Figure 5:
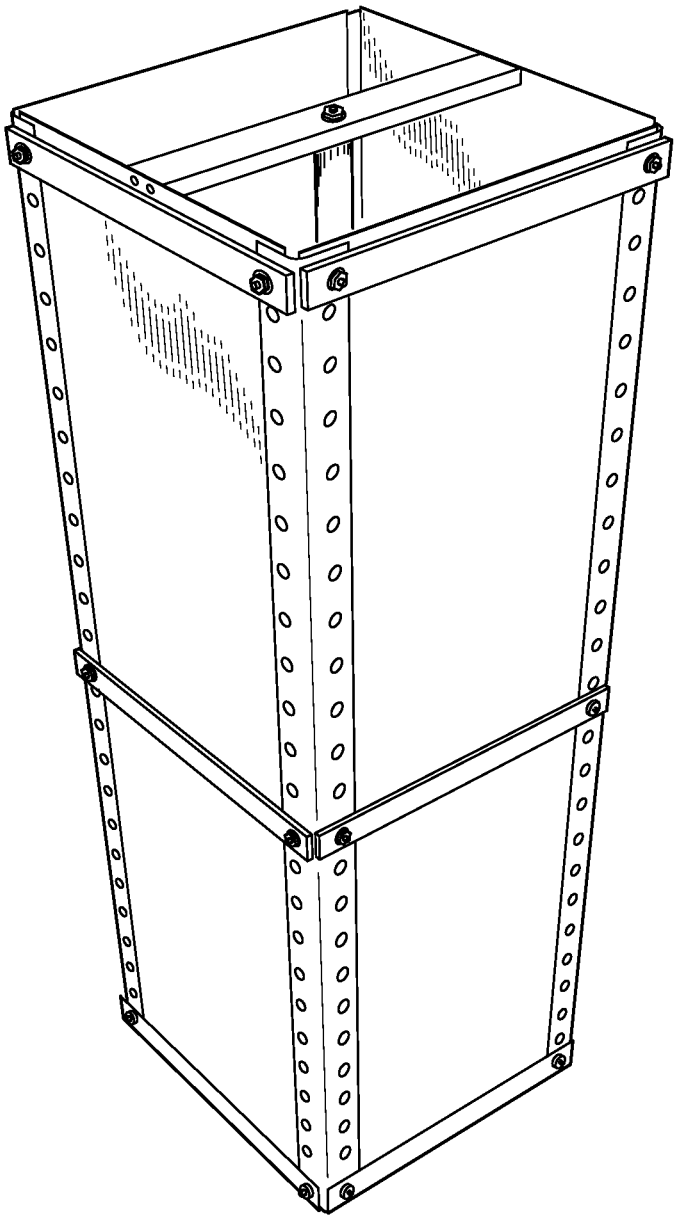
FIG. 5 is a side view in perspective illustrating the electrode test chamber for test set B.

Test Set B:

This test was conducted in the three feet long ESP chamber shown in FIG. 5. The discharge electrodes had 21 inches of exposed discharge surface. These tests were performed without any airflow. The purpose was to compare V-I characteristics of several configurations, some of which are shown in FIG. 4.

In FIG. 4, the electrodes shown are a carbon roving wrapped on a support rod (B1), four composite tapes with glass fibers and CNF stretched along the support rod (B2) and a carbon nanofiber fabric wrapped around the rod (B3). These electrodes B1, B2 and B3 were compared to a ninja star electrode similar to the A1 electrode.

Figure 6:
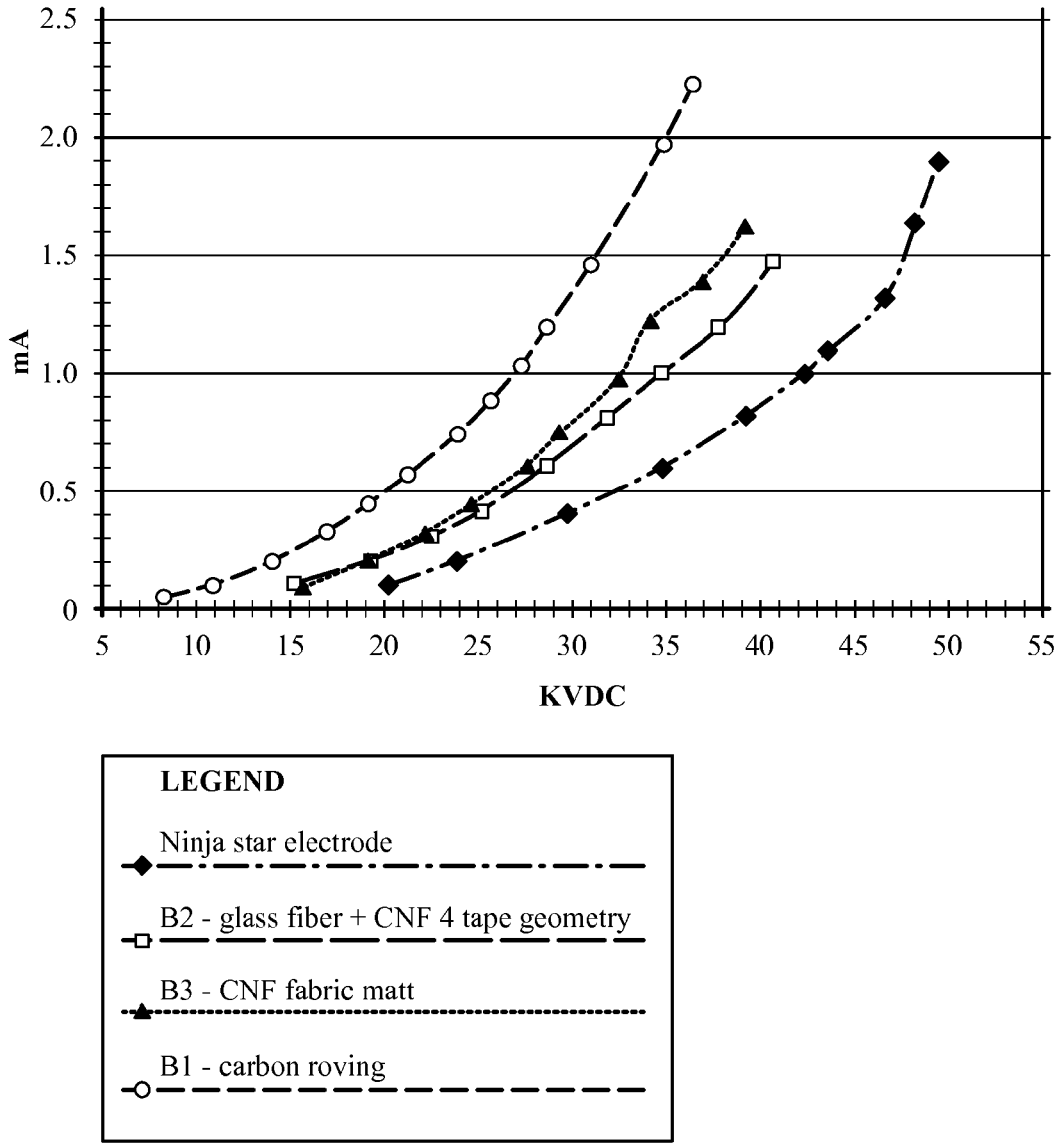
FIG. 6 is a table illustrating the results of V-I testing on four electrodes in the short chamber of FIG. 5.

The results from test set B are shown in FIG. 6 as the results of V-I testing on four electrodes in the short chamber. Conclusions that can be drawn from test set (B) are that the tests confirm the superiority of the carbon roving over the other electrodes. Additionally, the tapes do not necessarily have to be wrapped in a spiral around the support rod to provide a significant advantage. Instead, they can be stretched lengthwise along the rod as with B2. Still further, the carbon roving can be wrapped on a support rod with adhesive to improve the integrity of the structure. The adhesive can be selected to be conductive for enhanced performance. Furthermore, various geometric patterns can be used to hold the tapes to optimize the performance of tapes with or without a support rod. Finally, the carbon roving or other fibers and composites can be coated with polymer or metallic coating to improve performance and/or integrity in the ESP environment and improve the life of the electrode. Additional tests have shown that the V-I curve can be enhanced by using more tapes in each electrode.

Test Set C:

This set of tests was conducted to compare composite tapes of carbon rovings with and without carbon nanofiber (CNF). The electrodes were not supported by a central polymer pipe. Instead, each was in the shape of a 21 inch long, approximately 0.5 inch wide tape that was suspended in the short testing chamber (FIG. 5) as shown in a magnified view in FIG. 7. The test was conducted by keeping the sample under tension by pulling from both ends. The following electrodes were evaluated: (C1) a length of composite tape with carbon roving and CNF in polypropylene (PP); (C2) a length of composite tape with carbon roving in PP; (C3) a length of metal ribbon 0.5 inches wide; and (C4) a length of composite tape with glass roving and CNF in PP.

Figure 8:
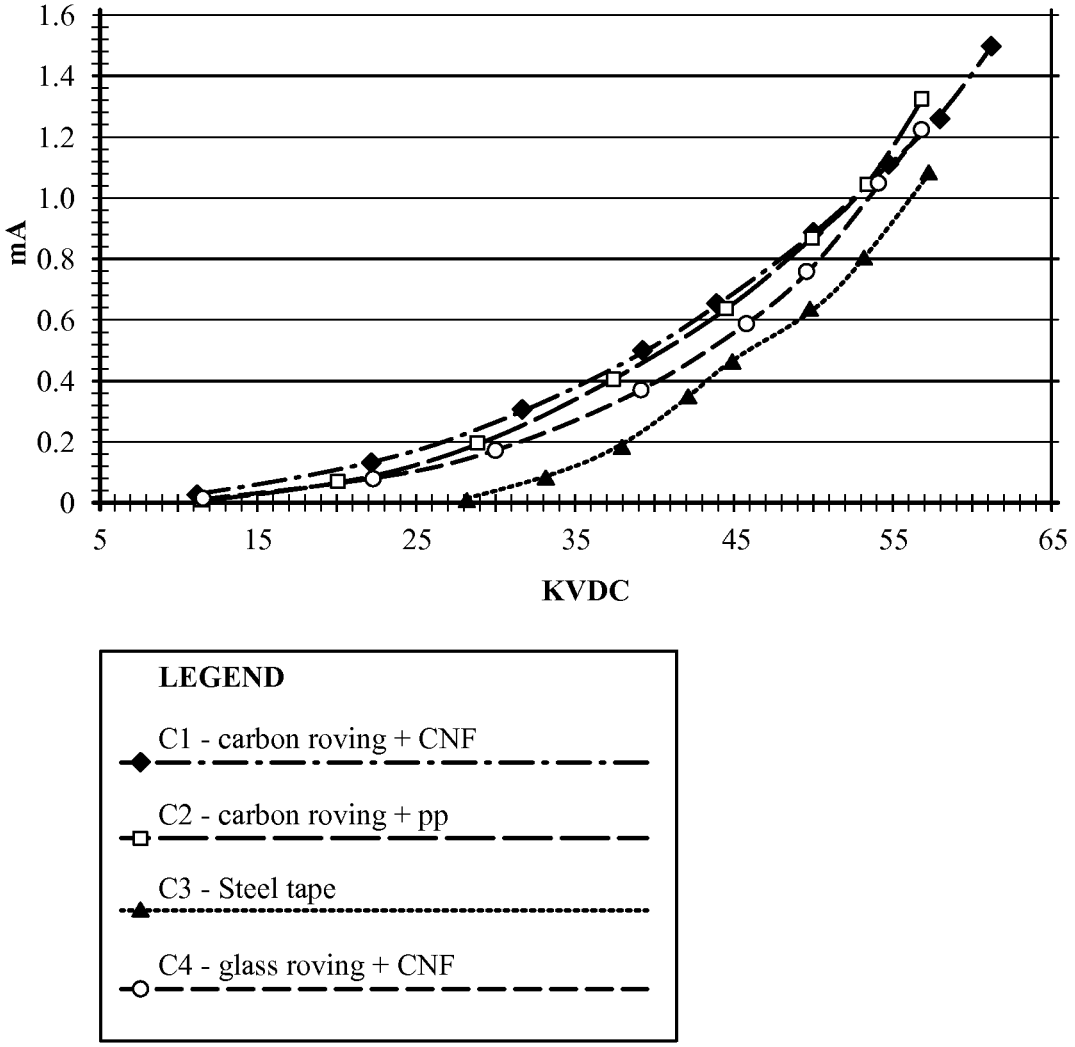
FIG. 8 is a table illustrating the results of V-I testing of a single suspended tape in the short test chamber of FIG. 5.

Since the total length of the tape is much shorter in the test C experiment, the currents in the V-I curve are also much less than the other two sets of experiment reported above. The results of test C (V-I testing of single suspended tape in the short test chamber) are shown in FIG. 8.

Conclusions from test set C include that all composite tapes performed much better than the metal tape electrode. Furthermore, the composite tapes or the conductive discharge elements do not have to be supported by a rod to perform well. Instead, they can be kept in tension between top and bottom supports rather than a support parallel to the axis of the electrode. This makes the tapes or fiber bundles simple and cost effective. Finally, the tapes can be made of an elastomer with nanofibers or nanotubes, which can then be stretched and wrapped between two parallel bars as a continuous, flexible electrode.

Summary and conclusions from test results are that the best V-I curve was obtained with a carbon roving as the discharge electrode. It performed much better than the ninja star electrode by a factor of 2 to 3. Additionally, the composite tapes generally performed at least as well as the ninja star, and were usually better by about 10%. The carbon roving tape with nanofiber appeared to perform slightly better than the other tapes. Feasible designs include the tapes or roving wrapped around a support rod, or stretched along the support rod, or suspended/stretched between two clamps or cylinders. A "carbon fiber brush" made of chopped continuous, conductive carbon fiber was also tested successfully. The ends of the carbon fibers acted as discharge points. The V-I characteristic was excellent, but because of the difference in the geometry it was not possible to compare this with the ninja star electrode.

A contemplated configuration for a discharge electrode system electrode made according to the invention using tape or fiber bundles with a non-conductive support is shown in FIG. 9. The flexible electrode can be a composite tape or tows of fibers or filaments. The support rod can be non-conductive (e.g. a composite fiberglass tube) or it can be conductive in other embodiments.

Although the FIG. 9 embodiment is one specific example, three general configurations are important. A first general configuration is one in which the flexible electrodes made of tape, fibers or filaments are stretched along the length of the support rod with a radial space or offset as shown in FIG. 9. A second general configuration is one in which the flexible electrode is bonded to the support rod (along the length or wrapped around it) so that there is no offset as shown in FIG. 4 (B3). A third general configuration is one in which the discharge electrode tapes, fibers or wires is stretched between support structures at the top and bottom of the gas flow path, and have no support rod extending the length of the tape, fiber or wire as shown in FIG. 7.

If no support rod is used, there can be advantages. First, the support rod can be removed from the design and the flexible electrodes stretched between top and bottom supports. Second, different density arrays (number of electrodes per unit area) of flexible electrodes can be stretched to produce corona discharge as needed. For example, higher density can be provided at the inlet of a dusty flow. Thus, the flexible electrodes can be distributed to provide different levels of corona discharge at different points in the ESP.

The light weight of the flexible electrode makes it easier to support and stretch within an ESP. This allows changing or increasing the spacing between the collector plates. Various methods for combining a polymer composite support to the discharge points and making electrical connections with the discharge points are discussed below. Of course, this discussion is not limiting, but is exemplary, and the person having ordinary skill will readily devise other methods based on the disclosure herein.

In general, it can be seen that the components in a "discharge electrode system" must provide three functions: (a) mechanical support, (b) electrical connectivity of the discharge points, and (c) discharge points for corona production. For describing the composite electrode, these functions are shown in the discharge electrode system in FIGS. 10, 11 and 12.

Figure 10:
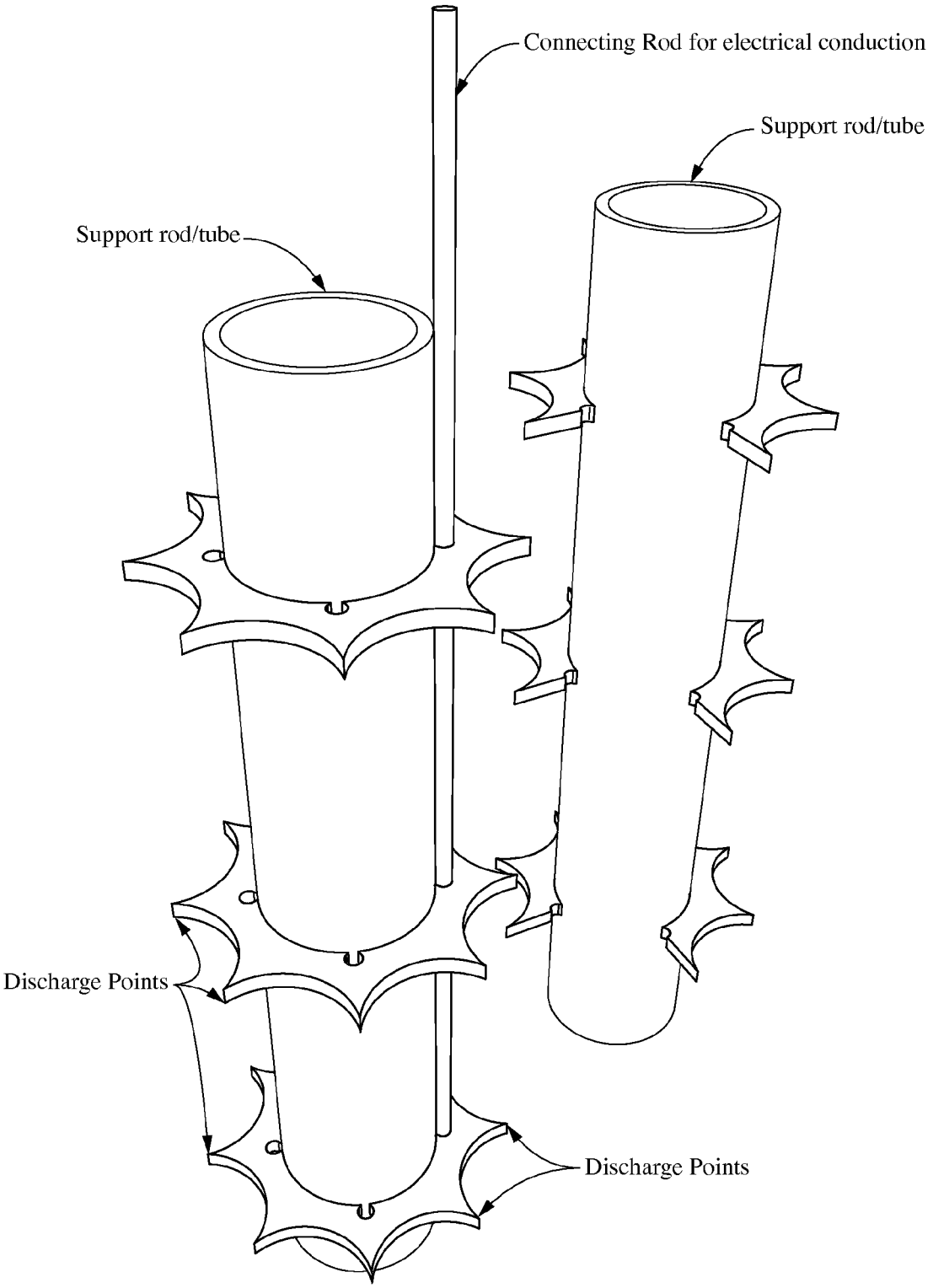
FIG. 10 is a view in perspective illustrating the parts of the discharge electrode system: (a) a mechanical support, (b) an electrically conductive medium (metal rod/wire), and (c) discharge points.
Figure 11:
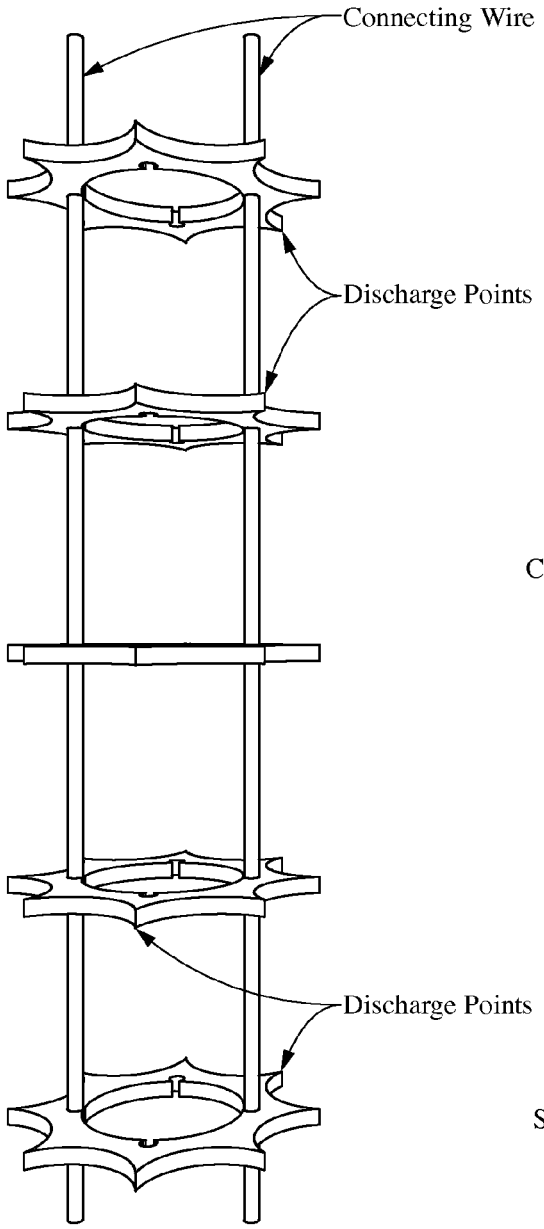
FIG. 11 is a schematic diagram illustrating discharge points with a conductive medium, such as a wire.
Figure 12:
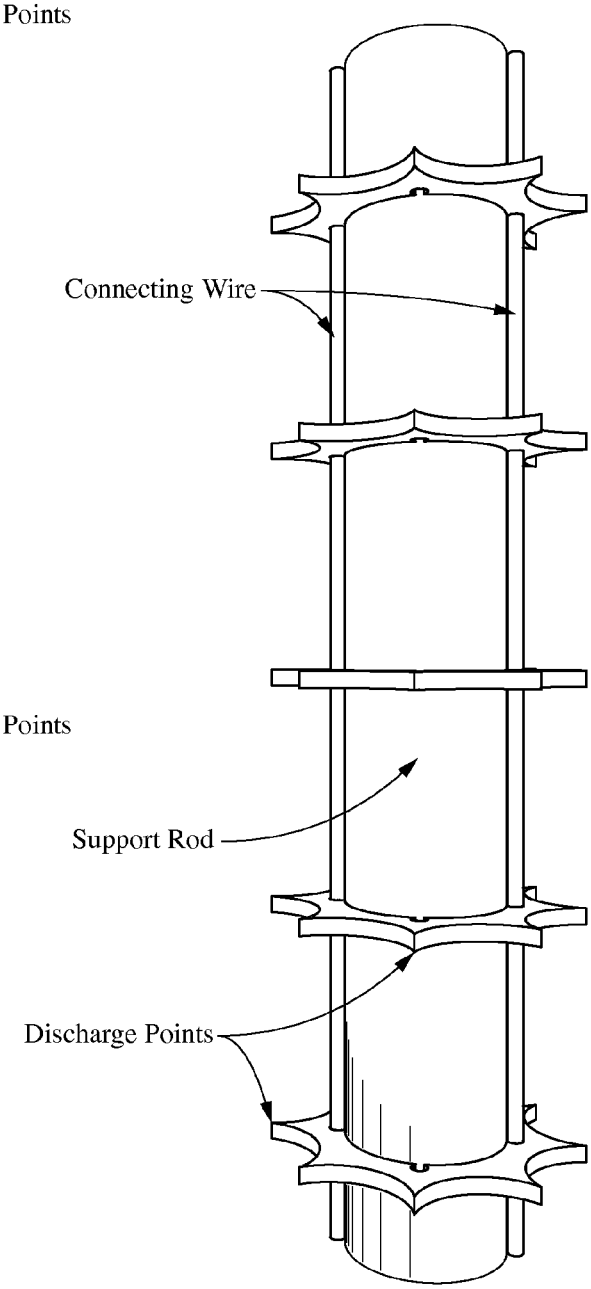
FIG. 12 is a schematic diagram illustrating a discharge electrode system comprising a central support rod, a conductive medium and discharge points.

FIG. 10 shows the component parts of the discharge electrode system including (a) a mechanical support, (b) an electrically conductive medium (metal rod/wire) and (c) discharge points. These components are shown schematically in FIGS. 11 and 12. FIG. 12 shows the discharge electrode system comprising a central support rod, conductive medium and discharge points.

Figure 13:
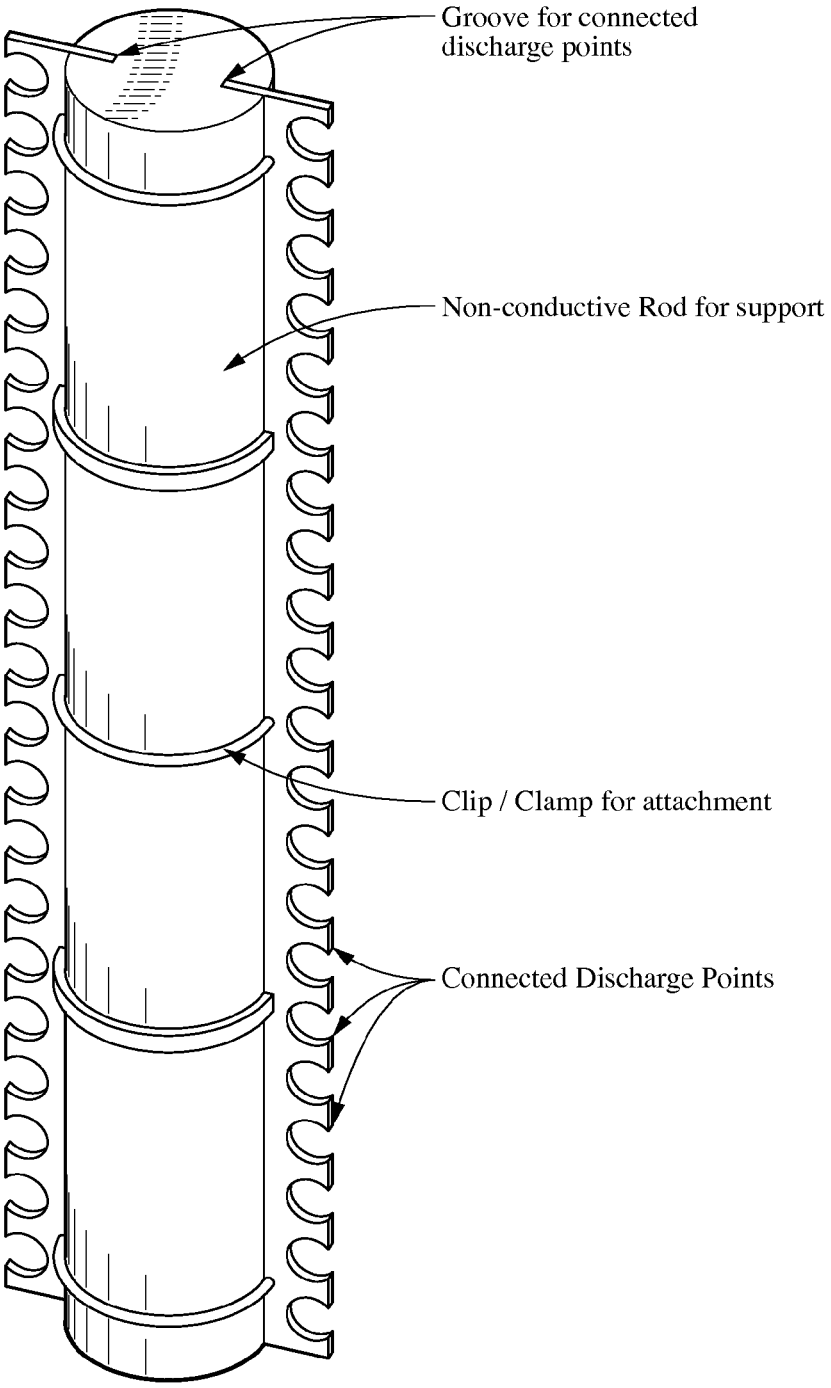
FIG. 13 is a view in perspective illustrating a support for discharge points using a slot in a non-conductive rod.

In the traditional approach, functions (a) and (b) of the discharge electrode are both performed by a metal support. The invention contemplates two types of innovation: (1) changing the metal to a different conductive material, such as using a conductive polymer composite rod, or (2) using different materials to perform the different functions, as shown in FIGS. 11 and 12. Other methods of attaching discharge points to the support rod are shown in FIGS. 13 and 14.

Figure 14:
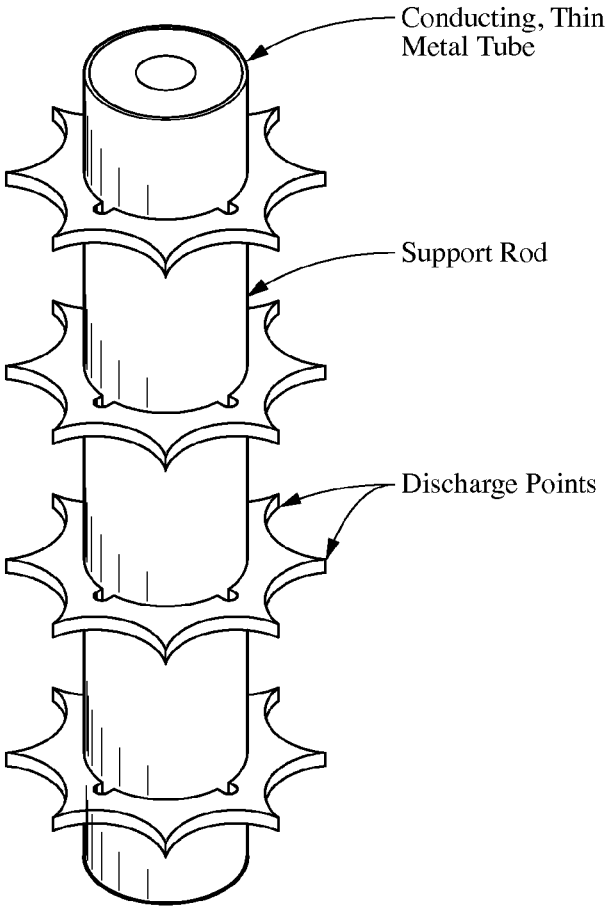
FIG. 14 is a view in perspective illustrating the support of discharge points by welding ninja stars on a thin metal tube that is supported by an inner non-conductive rod or tube. The cost advantage of this product arises from the replacement of the bulk of the metal by a composite rod/tube.

FIG. 14 shows supporting discharge points by welding ninja stars on a thin metal tube that is supported by an inner non-conductive rod or tube. A cost advantage comes from replacing the bulk of the metal by a composite rod/tube.

In the cases discussed above, the electrode support, which is the backbone that provides mechanical strength, is preferably provided by a polymer or a composite tube. The electrical connecting medium can be a wire, rod or thin tube that provides an electrically conductive path from the supply voltage to the discharge points. Other combinations of discharge points with a conducting wire or rod can be mounted on a non-conducting polymer or polymer-based composite, because the polymer can be processed in the molten form. This is described below.

Figure 15:
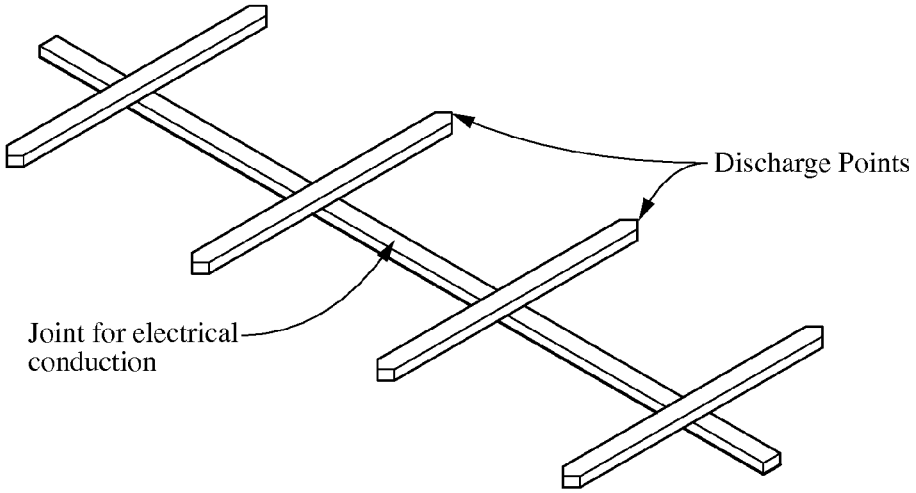
FIG. 15 is a view in perspective illustrating an example of "connected discharge points" where the materials can be metal, a conducting non-metal, a combination of both or a composite. The connection can be made using fibers, wires, rods, or other connectors.
Figure 16:
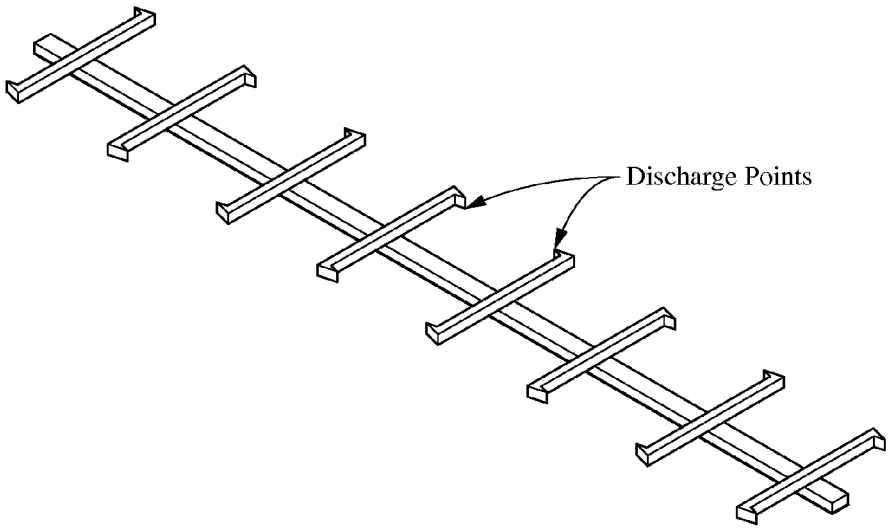
FIG. 16 is a view in perspective illustrating an example of "connected discharge points" where the points are of a different shape than that shown in FIG. 15. This demonstrates that different arrangements of discharge points can be used.

Different combinations of discharge points can be bonded to a conductive medium and embedded within a polymer-containing support rod. There can be several combinations of connected discharge points or spikes bonded to a conductive wire or thin rod, which can be embedded within a polymer or a polymer composite support rod. Examples are shown in FIGS. 15 and 16. FIG. 15 shows an example of "connected discharge points" where the materials can be metal, a conducting non-metal, combinations of both or a composite. The connection can be made using fibers, wires, rods, or other shapes. In FIG. 16 an example of "connected discharge points" is shown in which the points are of a different shape than that shown in FIG. 15. This demonstrates that different arrangements of discharge points can be used.

Thermoplastics, fiberglass composites and other non-conducting supports have at least the following advantages when used in the invention. With the thermoplastic composite support using carbon conducting fibers, it is possible to insert a hot metal discharge electrode point (e.g., a pin) through a thermoplastic to mount the metal discharge electrode point in the thermoplastic. A thin guide hole may be needed, and the process can be aided by using ultrasound or vibration. The polymer will melt and resolidify, producing a tight seal. The metal pins can be electrically connected either inside or outside the support rod.

Figure 17:
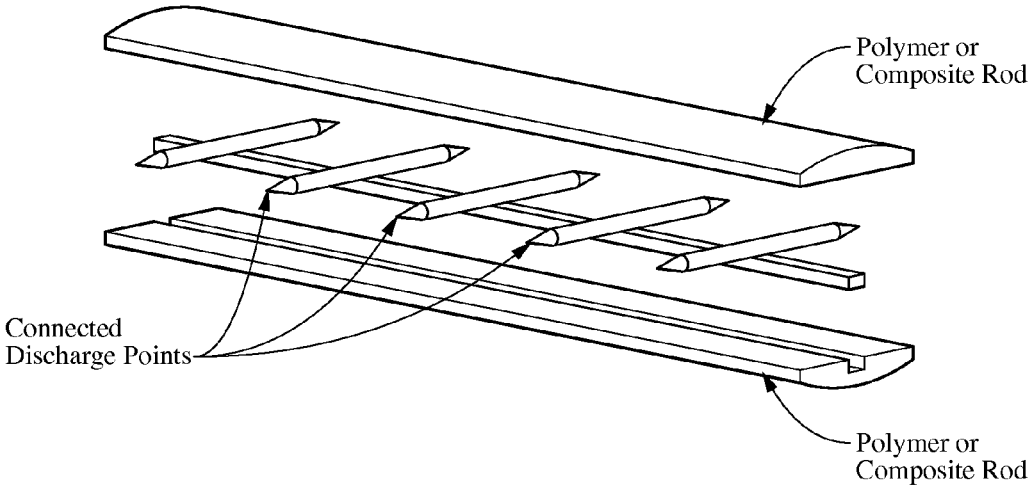
FIG. 17 is an exploded view in perspective illustrating a combination of connected discharge points and a support rod made of two halves of polymer and/or a composite material. It is also contemplated that one of the support halves can be only a thermoplastic, and the composite rod can have a coating of polymer.
Figure 18:
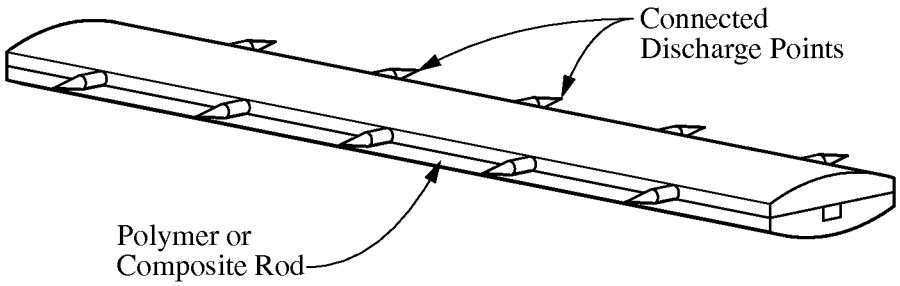
FIG. 18 is a view in perspective illustrating the discharge electrode system of FIG. 17 after the two halves shown in FIG. 17 are joined together.

It is also contemplated to join discharge points to a connecting wire or rod, which is then placed between two substantially parallel, non-conductive thermoplastic/composite rods and then the thermoplastic rods are joined around the connecting wire and the discharge points. It is possible for one of the support halves to be only a thermoplastic, and the composite rod can have a coating of polymer. This is illustrated in FIG. 17 as a combination of connected discharge points and a support rod made of two halves of polymer and/or a composite material. FIG. 18 shows the discharge electrode system after the two halves shown in FIG. 17 are joined together. The connecting rod, which can be cylindrical or other shapes, can strengthen the support rod made of polymer or composite.

Figure 19:
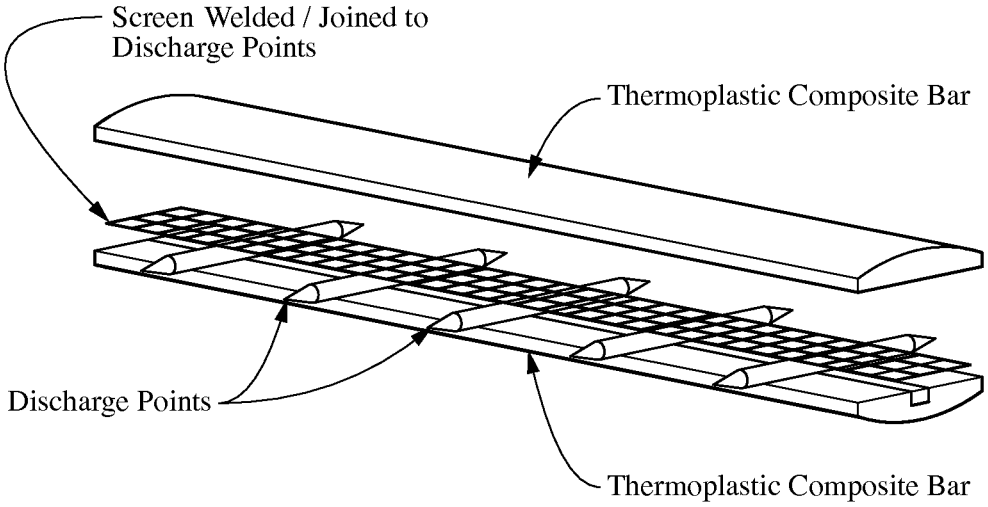
FIG. 19 is an exploded view in perspective illustrating an embodiment of the invention using a metal screen to provide a conductive path to discharge points, and as a joining aid between the connected discharge points and the polymer support rod. The support rod can be one or two composite rods, or a combination of a thermoplastic composite and pure thermoplastic rods.

Instead of using a metal connector, it is possible to use a non-metallic conducting fiber or conducting tape to connect the metal discharge points, and then the conductor is embedded within the support rod. The discharge points can be welded to a metal screen that is then placed between two thermoplastic composites. For convenience of joining, the composites can have a resin rich surface, which can melt and bond easily. This is shown in the illustration of FIG. 19. The screen can be heated electrically to melt the thermoplastic material for an improved joint. The metal screen provides the conductive path to the discharge points, and also as a joining aid between the connected discharge points and the polymer support rod. The support rod can be a single rod, or two composite rods, or a combination of thermoplastic composite and pure thermoplastic rod.

If carbon fiber or conducting fibers are to be used as discharge points, then a strip of carbon fabric or carbon rovings can be laid between two polymer bars and glued together, such that fiber ends are free and extend outside the support rod. The carbon fibers will provide strength to the composite. In this case, the support rod can be a thermoset composite. The final product looks like a brush.

Thermosets are easier to process for making composites because they flow easily before cure, and many of them will resist corrosive environments. The advantage of thermosets is that the "connected discharge points" can be embedded by curing a thermoset resin around it by a molding process. Thermosets can also be used to bond polymer support rods.

The attachment of the discharge electrode system to an ESP structure can be accomplished by attaching the connecting wire or rod to the support structure so that the weight of the electrode is supported. Additional clamps can be used to prevent lateral movement of the support rod, as shown in the example of FIG. 20. FIG. 20 shows a contemplated support system for an electrode incorporating the present invention. It is possible to increase the number of clamps for reducing lateral movements due to vibration, but the wires support the weight. This may be the simplest and least expensive systems for mounting the electrodes.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A discharge electrode for use in an electrostatic precipitator having a power supply connected to at least one collection electrode and a flow of gas through a gas passage across the discharge electrode and the collection electrode, the discharge electrode comprising a roving of carbon fibers infiltrated by a matrix material to form an elongated composite electrically connected to the power supply and exposed to the flow of gas, wherein said elongated composite extends through the flow of gas by being wound around first and second supports that are outside of the gas passage, whereby the elongated composite extends from the first support through the gas passage to and around the second support that is spaced from the first support, the elongated composite having substantial tension in spanning portions of the elongated composite that extend unsupported through the gas passage between the first and second supports.

2. The discharge electrode in accordance with claim 1, wherein the first support is a first cylinder and the second support is a second cylinder substantially parallel to the first cylinder.

3. A discharge electrode for use in an electrostatic precipitator having a power supply connected to at least one collection electrode and a flow of gas through a gas passage and across the discharge electrode and the collection electrode, the discharge electrode comprising a roving of carbon fibers infiltrated by a matrix material to form an elongated composite electrically connected to the power supply and exposed to the flow of gas, wherein said elongated composite extends through the flow of gas along an outer surface of a non-conductive rod that extends through the gas passage, wherein the elongated composite is aligned substantially parallel to the rod and is spaced radially from the rod to remain unsupported for at least a substantial length of a portion of the rod that extends through the gas passage.

* * * * *